United States Patent [19]

Lang

[11] Patent Number: 4,661,787

[45] Date of Patent: Apr. 28, 1987

[54] WAVEGUIDE

[75] Inventor: Manfred Lang, Taufkirchen, Fed. Rep. of Germany

[73] Assignee: Spinner GmbH, Elektotechnische Fabrik, Munich, Fed. Rep. of Germany

[21] Appl. No.: 808,357

[22] Filed: Dec. 12, 1985

[30] Foreign Application Priority Data

Dec. 18, 1984 [DE] Fed. Rep. of Germany ..... 3446196

[51] Int. Cl.[4] ..... H01P 1/22; H01P 1/26

[52] U.S. Cl. ..... 333/22 R; 333/81 B; 333/239

[58] Field of Search ..... 333/22 R, 22 F, 81 B, 333/239, 242, 248, 251

[56] References Cited

U.S. PATENT DOCUMENTS

| | | | |
|---|---|---|---|
| 2,656,515 | 10/1953 | Hansen et al. | 333/248 X |
| 3,158,824 | 11/1964 | Larsen et al. | 333/239 X |
| 3,184,695 | 5/1965 | Unger | 333/251 |
| 3,748,606 | 7/1973 | Kaufman et al. | 333/239 X |

*Primary Examiner*—Paul Gensler

*Attorney, Agent, or Firm*—Henry M. Feiereisen

[57] ABSTRACT

A waveguide usable as absorber or as attenuator for high radio-frequency powers up to highest frequencies includes a tube with a dissipative material at whose inside a metallized layer is applied. The thickness of the metallized layer changes along the length of the tube with its initial thickness and end thickness determined in such a manner that a constant power density is obtained along the waveguide.

11 Claims, 2 Drawing Figures

WAVEGUIDE

FIELD OF THE INVENTION

The present invention refers to a waveguide with a highly dissipative material as absorbing material for guiding electromagnetic waves especially radio-frequency waves or high-frequency waves in the gigahertz range.

BACKGROUND OF THE INVENTION

In general, waveguides with highly dissipative material are used as absorbers that is matched terminations and as attenuators. The waveguides are provided with a metallic wall surrounding the field in which the dissipative material is arranged in such a manner that a small reflection coefficient is obtained over a wide frequency range and simultaneously, a close heat contact is provided between the dissipative material and the inner wall of the waveguide in order to carry off the heat generated by converting the radio-frequency power through the wall which is suitably cooled at higher power.

The provision of a coating of dissipative material within the field is, however, reduced with increasing frequency of the rf-wave and thus decreasing cross section of the waveguide. Since at increasing frequency also the loss per unit of length of the dissipative material increases and the penetration depth of the rf-wave decreases, considerable power densities are obtained in the area of several gigahertz. In known waveguides, the maximum admissible radio-frequency power at which the temperature of the absorbing material reaches its maximum value, becomes thus steadily smaller with increasing frequency.

OBJECT OF THE INVENTION

It is thus the principal object of the present invention to provide an improved waveguide obviating the aforestated drawbacks.

SUMMARY OF THE INVENTION

This object is realized in accordance with the invention by providing a tube whose inside is lined with a coating of highly dissipative material to which a metallized layer is applied. The metallized layer has a thickness continuously changing along the tube in propagating direction of the wave.

According to the teachings of my invention, the thickness of the metallized layer continuously decreases in direction of propagation of the electromagnetic wave e.g. a radio-frequency wave from an initial width in the magnitude of the penetration depth of the wave towards the value zero.

Through the provision of such a metallized layer, the radio-frequency power is automatically converted into heat in the wall of the waveguide so that disturbances or unevenness of the cross section of the waveguide and resulting reflections are prevented, and simultaneously an effective cooling from outside is possible. Since the length-dependent metallized layer depends on the given penetration depth of the rf-wave, the absorption is not concentrated to a small area but is distributed over the entire length of the waveguide. In the ideal case, the power density and thus the excess temperature is the same over the entire length of the waveguide.

Depending on the thickness of the metallized layer, the waveguide according the invention can be used as absorber or attenuator. When providing the metallized layer with decreasing cross section along the length of the tube, the use of the waveguide as attenuator is limited to a propagation of the wave in direction of decreasing thickness of the metallized layer.

Therefore, according to another feature of the invention, the tube is provided with a metallized layer having a first section of decreasing thickness and a second section of increasing thickness and continuing the first section in propagating direction. Preferably, the center plane of the tube is used as reference line which means that the thickness of the first section of the metallized layer decreases in direction of the propagating wave towards the center plane and the second section is of increasing thickness from the center plane in direction of the propagating wave. This feature provides an attenuator which can be used independent on the propagation direction of the wave.

The waveguide according to the invention is usable even at a frequency range above e.g. 10 gigahertz for high rf-powers (e.g. more than 1 kilowatt) in a broadband manner with hardly any reflection.

BRIEF DESCRIPTION OF THE DRAWING

The above and other objects, features and advantages of the present invention will now be described in more detail with reference to the accompanying drawing in which.

SPECIFIC DESCRIPTION

Figure 1:
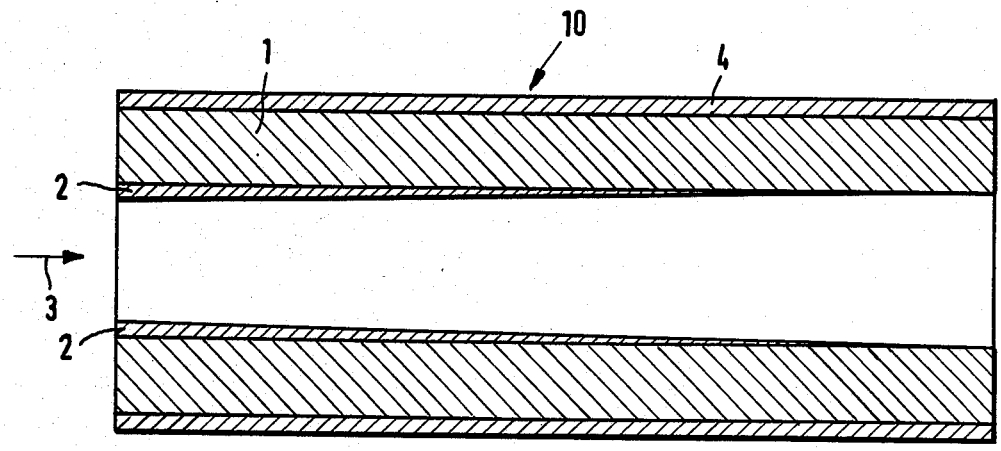
FIG. 1 is a longitudinal section of one embodiment of a waveguide according to the invention.

In FIG. 1, there is shown a first embodiment of a waveguide according to the invention and generally designated by reference numeral 10. The waveguide 10 includes a hollow conducting tube 4 of metal, preferably of metal which conducts heat well which at its opposing ends is connected to not shown flanges and whose inside is lined with a coating of highly dissipative or absorbing material e.g. a semiconductor like silicon carbide. Along the inside of the coating 1, a metallized layer 2 is applied which in direction of propagation of an electromagnetic wave e.g. radio-frequency wave from the left hand side to the right hand side as indicated by arrow 3 in FIG. 1 has a thickness or cross section continuously decreasing to zero from an initial thickness of a magnitude corresponding to the penetration depth of the wave. The layer 2 whose widest thickness is a few micrometers can be made of silver or a silver/nickel alloy and may be applied through coating by evaporation in a high vacuum.

Depending on the thickness of the layer 2, the waveguide 10 can be used as an attenuator or an absorber. At a length of 150 mm and a suitable cooling, such an absorber can be provided with a radio-frequency power of more than 1 KW at a frequency range from 30 to 40 gigahertz and a reflection of less than 1%.

In case the metallized layer 2 has a wider thickness which does not necessarily decrease to zero, the waveguide 10 is used as an attenuator. In view of a uniform power density distribution over the length of the waveguide and an electric continuity of the insides, such an attenuator is limited, however, to a use in which the rf-wave propagates only in direction of decreasing thickness of the metallized layer 2, that is from left to right as indicated by arrow 3 in FIG. 1.

Figure 2:
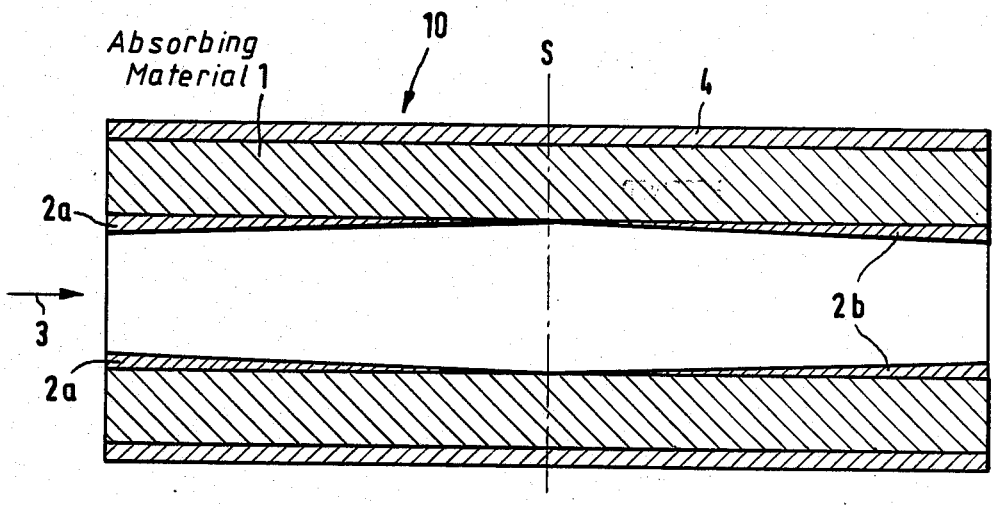
FIG. 2 is a longitudinal section of another embodiment of a waveguide according to the invention.

In FIG. 2, a second embodiment of the waveguide 10 is illustrated which is usable also as an attenuator independent, however, of the propagating direction of the rf-wave. Accordingly, the inside of the coating 1 is lined with a pair of metallized layers *2a,2b* arranged symmetrically to the center plane S of the tube 4. The layer *2a* has a thickness decreasing towards the center plane S in propagating direction of arrow 3 while the layer *2b* extends from the center plane S with increasing thickness. The waveguide 10 according to the second embodiment can be loaded from both sides with a high power and does not show an electric discontinuity at its both connecting flanges.

Depending on the radio-frequency power converted in the waveguide 10, the coating 1 of dissipative material may be in tight heat conducting contact with a coolant. It should be noted that basically all known cooling methods may be employed which may include a profiling of the outer sides to increase its surface and/or the use of a metal cooler which encases the waveguide 10. Inaddition, hot cooling could be provided or the tube 4 is provided with boreholes or channels for allowing a cooling fluid (gas or liquid) to flow therethrough.

While the invention has been illustrated and described as embodied in a waveguide, it is not intended to be limited to the details shown since various modifications and structural changes may be made without departing in any way from the spirit of my present invention.

What is claimed as new and desired to be protected by Letters Patent is set forth in the appended claims:

1. A waveguide for electromagnetic waves; comprising: a tube having an inner wall lined with a coating of highly dissipative material and with a metallized layer along the inside of said coating, said metallized layer having a thickness continuously decreasing in direction of propagation of the waves through said tube from an initial thickness of a magnitude in correspondence with the penetration depth of the waves.

2. A waveguide as defined in claim 1 wherein the thickness of said metallized layer is continuously reduced towards zero in direction of propagation of the wave from an initial thickness of a magnitude in correspondence with the penetration depth of the wave.

3. A waveguide as defined in claim 1 wherein said coating of dissipative material is a semiconductor.

4. A waveguide as defined in claim 3 wherein said coating of dissipative material is made of silicon carbide.

5. A waveguide as defined in claim 1 wherein said metallized layer is made of silver.

6. A waveguide as defined in claim 1 wherein said metallized layer is made of silver-nickel alloy.

7. A waveguide for electromagnetic waves; comprising: a tube having an inner wall lined with a coating of highly dissipative material and with a metallized layer along the inside of said coating wherein said tube defines a center plane, said metallized layer having a first section of a thickness continuously decreasing towards said center plane in direction of propagation of the wave and a second section of a thickness continuously increasing from said center plane in propagating direction of the wave.

8. A waveguide as defined in claim 7 wherein said coating of dissipative material is a semiconductor.

9. A waveguide as defined in claim 8 wherein said coating of dissipative material is made of silicon carbide.

10. A waveguide as defined in claim 7 wherein said metallized layer is made of silver.

11. A waveguide as defined in claim 7 wherein said metallized layer is made of silver-nickel alloy.

* * * * *